US006514382B1

(12) United States Patent
Kakiuchi et al.

(10) Patent No.: US 6,514,382 B1
(45) Date of Patent: Feb. 4, 2003

(54) PROCESS FOR PRODUCING BULKY PAPER

(75) Inventors: Shusuke Kakiuchi, Tochigi (JP); Kazuhiro Inaba, Tochigi (JP); Hiroyuki Yanagida, Tochigi (JP); Taeko Hayase, Tochigi (JP); Toshiyuki Suga, Tochigi (JP); Hiroyuki Akai, Tochigi (JP); Takao Koyama, Tochigi (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/720,880

(22) PCT Filed: Aug. 3, 1999

(86) PCT No.: PCT/JP99/04188

§ 371 (c)(1),
(2), (4) Date: Jan. 2, 2001

(87) PCT Pub. No.: WO01/11125

PCT Pub. Date: Feb. 15, 2001

(51) Int. Cl.[7] ..... D21H 27/02
(52) U.S. Cl. ..... 162/109; 162/115; 162/207
(58) Field of Search ..... 162/109, 111, 162/113, 117, 115, 206, 116, 207, 204, 297, 289, 290, 375

(56) References Cited

U.S. PATENT DOCUMENTS 3,994,771 A 11/1976 Morgan, Jr. et al.
5,514,523 A * 5/1996 Trokhan et al. ..... 162/117

FOREIGN PATENT DOCUMENTS

| | | |
|---|---|---|
| JP | 7-502077 | 3/1995 |
| JP | 2639438 | 5/1997 |
| JP | 9-506937 | 7/1997 |
| JP | 10-245789 | 9/1998 |
| JP | 10-245790 | 9/1998 |
| WO | WO9116491 | 10/1991 |
| WO | WO9116492 | 12/1991 |
| WO | WO 95/17548 | 6/1995 |
| WO | WO0111125 | 2/2001 |

OTHER PUBLICATIONS

Japanese Patent Office Notice of Rejection.

* cited by examiner

*Primary Examiner*—Peter Chin
(74) *Attorney, Agent, or Firm*—Birch, Stewart, Kolasch & Birch, LLP

(57) ABSTRACT

A process for producing bulky paper comprising the steps of transferring a fiber web (2) having a water content of 50 to 85% by weight to a patterning zone having a perforated patterning net (31) revolving along a suction unit; patterning the fiber web (2) in conformity to the perforated patterning net (31) by sucking the fiber web (2) which is held on the perforated patterning net (31) while applying 5 kcal/kg or more of heat to the fiber web (2) in a heat application zone simultaneously with or before or after the sucking of the fiber web (2); and then drying the fiber web (2) in a drying zone to obtain patterned bulky paper (3).

8 Claims, 5 Drawing Sheets

PROCESS FOR PRODUCING BULKY PAPER

This application is the national phase under 35 U.S.C. §371 of PCT International Application No. PCT/JP99/04188 which has an International filing date of Aug. 3, 1999, which designated the United States of America.

TECHNICAL FIELD

The present invention relates to a process for producing bulky paper which is preferably used as an absorbent base, etc. of cooking paper, paper towels, tissues, paper products for cleaning, sanitary materials, and the like.

BACKGROUND ART

Conventional papermaking techniques include a process comprising forming a fiber web by use of a smooth paper layer-forming belt or carrier belt having fine openings and uniformly pressing the fiber web for dewatering and a process comprising drying the fiber web by passing in hot air of a through air drier without pressing for dewatering. However, these processes have not achieved appreciable increases in paper thickness, water absorption capacity, and the like.

Known processes of producing bulky paper comprising imparting a pattern by suction to a wet fiber web before being dried, passing the fiber web (not compressed) in hot air to half dry, and finally drying in a Yankee drier include a process using a perforated patterning carrier belt having 100 to 3600 openings each having an open area of 0.0072 $mm^2$ to 2.1 $mm^2$ per 6.45 $cm^2$ (see Japanese Patent Application Laid-Open No. 21405/77) and a process using a composite perforated patterning carrier belt composed of a perforated patterning resin with prescribed openings which is prepared by using a photosensitive resin and a conventional papermnaking carrier belt which reinforces the resin (see Japanese Laid-Open No. 5-506277 and Japanese Laid-Open No. 5-506893).

The process disclosed in Japanese Patent Application Laid-Open No. 21405/77 is incapable of directing softwood pulp having a relatively long fiber length toward the openings to form low-density projections.

According to the processes disclosed in WO 93/506277 and WO 93/506893, if the open area of the perforations is less than 3 $mm^2$, the low-density projections formed by suction have an insufficient volume for obtaining sufficient thickness, water absorption capacity, and softness. Further, because the resin part of the perforated patterning carrier belt is rubbed with many reverse rolls and the surface of a Yankee drier under a strong pressure, the processes are disadvantageous from the standpoint of belt life. Furthermore, much time is required to remove or change the belt, and it is infeasible to alternate the manufacture of plain paper and bulky paper or to easily alter the pattern of bulky paper.

DISCLOSURE OF THE INVENTION

Accordingly, an object of the present invention is to provide a process for producing bulky paper having a large thickness, good absorption, excellent softness, and moderate strength.

Another object of the present invention is to provide a highly productive process for producing bulky paper.

Still another object of the present invention is to provide a process for producing bulky paper which copes with long-term continuous operation and allows the system to be switched to general papermaking or allows the pattern to be altered easily.

The present inventors have found that the above objects are accomplished by carrying out patterning in a patterning zone having a perforated patterning net in a specific stage of the bulky paper production process while applying a specific quantity of heat.

The present inventors have also found that the above objects are accomplished by carrying out patterning in a patterning zone having a specific perforated patterning net in a specific stage of the bulky paper production process.

The above objects are accomplished by providing a process for producing bulky paper comprising the steps of transferring a fiber web having a water content of 50 to 85% by weight to a patterning zone having a perforated patterning net revolving along a suction unit; patterning the fiber web in conformity to the perforated patterning net by sucking the fiber web which is held on the perforated patterning net while applying 5 kcal/kg or more of heat to the fiber web in a heat application zone simultaneously with or before or after the sucking of the fiber web; and then drying the fiber web in a drying zone to obtain patterned bulky paper.

The above objects are also accomplished by providing a process for producing bulky paper comprising the steps of transferring a fiber web having a water content of 50 to 99% by weight to a patterning zone which is provided before a drying zone and has a suction unit and a perforated patterning net revolving along the suction unit; patterning the fiber web in conformity to the perforated patterning net by sucking the fiber web which is held on the perforated patterning net; and then drying the fiber web in the drying zone to obtain patterned bulky paper, the perforated patterning net comprising a reinforcing carrier belt and a perforated patterning structure which is disposed on the reinforcing carrier belt and on which the fiber web is to be built up, the reinforcing carrier belt having an individual opening area of 0.01 to 10 $mm^2$, an open area ratio of 10 to 70%, and a tensile strength of 20 kg/cm or more in the longitudinal direction thereof, and the perforated patterning structure having an individual opening area of 3 to 25 $mm^2$ and an open area ratio of 18 to 96%, a least width of 0.1 to 5 mm in the pattern-forming constituent parts thereof in the planar direction, and a thickness of 0.3 to 1.5 mm.

The above objects are also accomplished by providing a process for producing bulky paper comprising the steps of transferring a fiber web having a water content of 50 to 99% by weight to a patterning zone which is provided before a drying zone and has a suction unit and a perforated patterning net revolving along the suction unit; patterning the fiber web in conformity to the perforated patterning net by sucking the fiber web which is held on the perforated patterning net; and then drying the fiber web in the drying zone to obtain patterned bulky paper, the perforated patterning net having an individual opening area of 3 to 8 $mm^2$, an open area ratio of 15 to 65%, a least width of 0.2 to 5 mm in the pattern-forming constituent parts thereof in the planar direction, a thickness of 0.5 to 3.0 mm, and a tensile strength of 20 kg/cm or more in the longitudinal direction thereof

THE BEST MODE FOR CARRYING OUT THE INVENTION

Preferred embodiments of the process for producing bulky paper according to the present invention will be described in detail with reference to the drawings.

Figure 1:
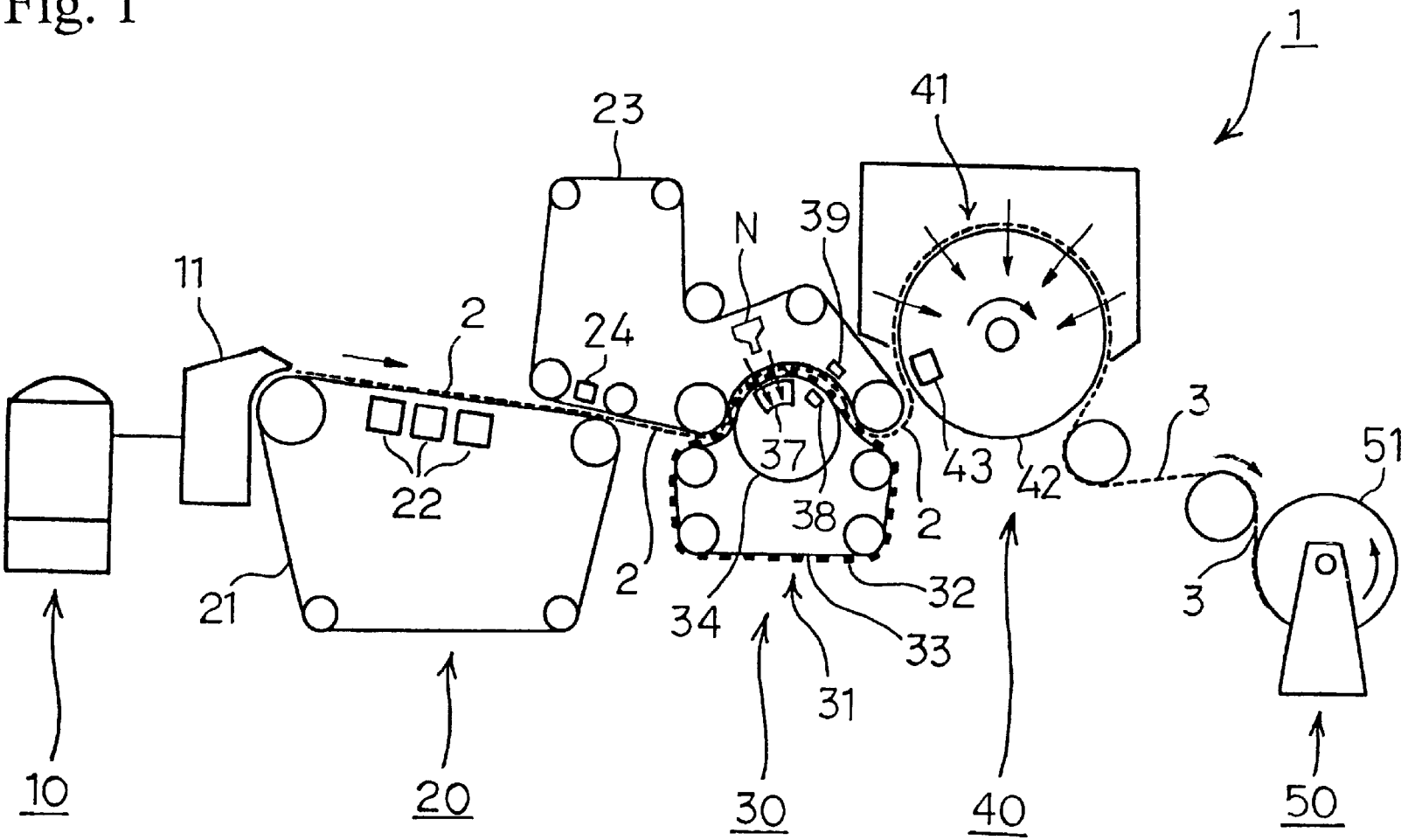
FIG. 1 is a schematic illustration of the apparatus used in a first embodiment of the bulky paper production process according to the present invention.

In FIG. 1 is shown an apparatus used in the first embodiment of the present invention. The apparatus (paper machine) 1 is an apparatus for manufacturing bulky paper having a patterning zone between a paper layer forming zone and a drying zone, the patterning zone having a suction drum 34, a steam spray nozzle N, and a perforated patterning net 31 which revolves along a part of the peripheral surface of the suction drum 34. The apparatus 1 comprises a raw material feeding unit 10, a paper layer forming unit 20, a patterning unit 30, a drying unit 40, and a winding unit 50.

The raw material feeding unit 10 has a stock feed head 11. A fiber slurry having a prescribed concentration is fed from the stock feed head 11 to the paper layer forming unit 20.

The paper layer forming unit 20 has a paper layer-forming belt 21 and a suction box 22 for dewatering which is provided in contact with the paper layer forming-belt 21. The paper layer-forming belt 21 is a wire mesh belt used in general paper machines. The suction box 22 dewaters a fiber web 2 formed on the paper layer-forming belt 21 to adjust the water content of the fiber web 2 to be transferred to the downstream patterning unit 30. A pickup carrier belt 23 runs over the zone from the paper layer forming unit 20, through the patterning unit 30 to the drying unit 40 to enable stable transfer of the fiber web 2. A suction box 24 serves to transfer the fiber web 2 from the paper layer-forming belt 21 to the pickup carrier belt 23.

Figure 2A:
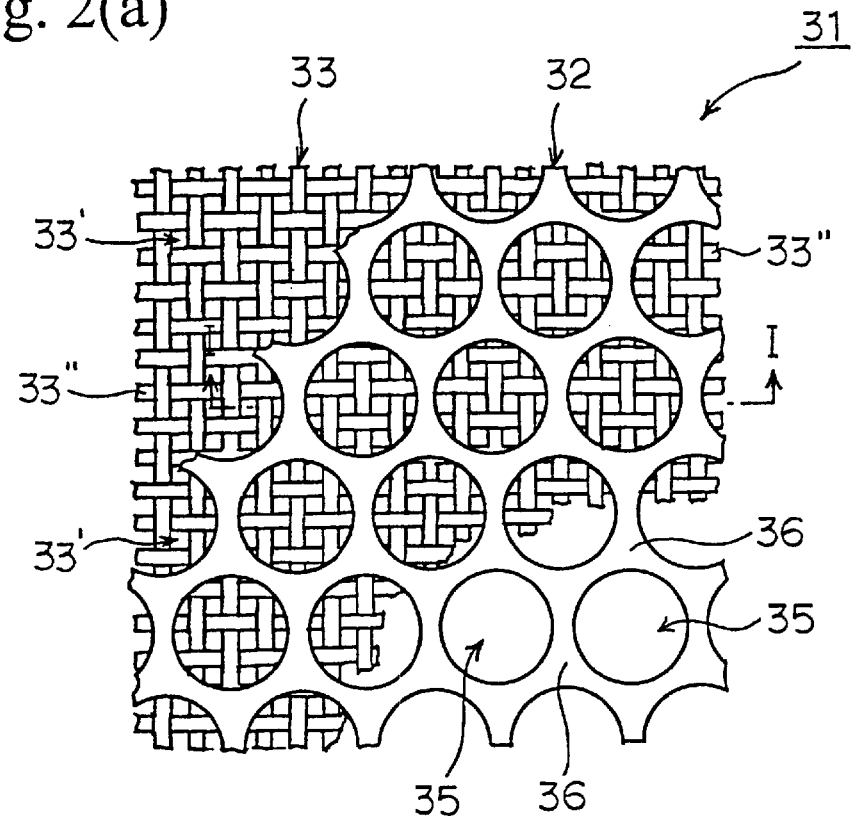
FIG. 2(*a*) is an enlarged partial plan view of a perforated patterning net, and FIG. 2(*b*) is a cross sectional view taken along line I—I of FIG. 2(*a*).
Figure 2B:
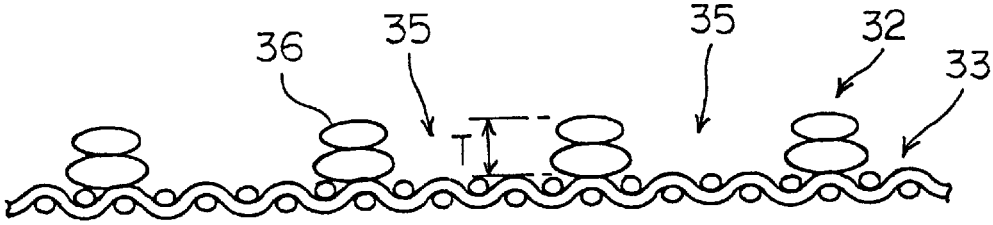

The patterning unit 30 has a suction drum 34, a steam spray nozzle N, and a perforated patterning net 31 which revolves along a part of the peripheral surface of the suction drum 34. As shown in FIGS. 2(*a*) and (*b*), the perforated patterning net 31 is composed of a reinforcing carrier belt 33 made of a resin wire mesh and a perforated patterning structure 32 which is superposed on the outer peripheral surface of the reinforcing carrier belt 33 and on which the fiber web 2 is held. The suction drum 34 contains inside a suction box 37. As shown in FIG. 1, the suction box 37 is placed inside the suction drum 34 at the position where the perforated patterning net 31 runs in contact therewith so that air may be sucked in through the perforated patterning net 31. The steam spray nozzle N is set outside the perforated patterning net 31 at the position facing the suction box 37 so that steam may be sprayed over the whole width of the fiber web 2. The patterning unit 30 has an air nozzle 38 and a weak suction box 39 so that the fiber web 2 clinging to the perforated patterning net 31 can easily be transferred to the pickup carrier belt 23.

In the patterning unit 30, the steam spray nozzle N is designed to spray steam to the fiber web 2 at a prescribed temperature at a prescribed flow speed. Since the steam spray nozzle N faces the suction box 37 in this embodiment as stated above, heat application by steam spraying onto the fiber web 2 and suction of the fiber web 2 are carried out simultaneously.

In order to impart a pattern to the wet fiber web 2 by suction, it is important to provide a patterning zone having the perforated patterning net 31, the suction drum 34,, and the steam spray nozzle N. The patterning zone can be at any position between the paper layer forming zone and the drying zone of the apparatus 1.

The drying unit 40 has a drum-shaped through air drier (hereinafter referred to as a drier) 41 which is designed to allow hot air to pass therethrough from the outside into the inside. A mesh net 42 is attached to the peripheral surface of the drier 41. The net 42 has such a mesh size as causes no hindrance to the passage of hot air. A suction box 43 is provided inside the drier 41 near the lower portion thereof thereby to facilitate transfer of the fiber web 2 coming from the patterning unit 30 to the net 42. The winding unit 50 has a winder 51 for taking up produced bulky paper 3.

As described above, the perforated patterning net 31 is composed of the perforated patterning structure 32 and a reinforcing carrier belt 33. The perforated patterning structure 32 is a plastic net prepared by melt extrusion of a thermoplastic resin. It has a large number of circular openings over the entire area thereof to form a mesh pattern. The perforated patterning structure 32 and the reinforcing carrier belt 33 are united into one body by sewing.

The openings 35 of the perforated patterning structure 32 shown in FIGS. 2(*a*) and (*b*) each preferably have an area of 3 to 25 $mm^2$. With the individual opening area being 3 $mm^2$ or wider, fibers are sufficiently obliquely oriented into the openings 35 to form satisfactory low-density projections (corresponding to the regions with a low fiber density, hereinafter described) in bulky paper. With the opening area being 25 $mm^2$ or smaller, the fibers are effectively prevented from falling off to make holes, and formation of high-density regions (corresponding to the regions with a high fiber density, hereinafter described) in a mesh pattern is secured sufficiently to efficiently provide bulky paper with sufficient strength. It is still preferred for each opening to have an area of 4 to 10 $mm^2$, particularly 5 to 8 $mm^2$.

The area of the individual openings 35 is related to the open area ratio of the perforated patterning structure 32. It is preferred for the openings 35 not only to have an individual area falling in the above-described range but to have a total area in a ratio of from 18 to 96%, particularly 40 to 87%, especially 50 to 75%, from the standpoint of absorption capacity, texture, and strength of the bulky paper. The term "open area ratio" as used herein means the value measured as for only the portion of the perforated patterning structure 32 where the openings 35 are made. For example, both side portions of the perforated patterning structure 32 where the openings 35 are not formed are excluded from the object of measurement.

The area of the individual openings 35 is also related to the width of the net-constituent parts 36 which form (surround) the individual openings 35 (see FIGS. 2(*a*) and (*b*)). From the viewpoint of strength and texture of the bulky paper, it is preferred not only that the openings 35 have an individual area falling within the above-described range but that the constituent parts 36 have a least width of 0.1 to 5 mm, particularly 0.2 to 2 mm, especially 0.3 to 1 mm, in the planar direction (i.e., in the plan view of the perforated patterning structure 32). In cases where the constituent part has a varied width (e.g., where the perforated patterning structure 32 has a circular openings as shown in FIGS. 2(*a*) and (*b*)), the term "a least width" as used herein means the narrowest width in the plan view of that part. Where the constituent part has a constant width in its plan view, that width is meant by this term.

It is also preferred for the perforated patterning structure 32 to have a thickness T (see FIG. 2(*b*)), namely the depth of the openings 35, of 0.3 to 1.5 mm, particularly 0.4 to 1.0 mm, especially 0.5 to 0.8 mm. With the thickness being 0.3 mm or more, fibers are sufficiently directed toward the openings 35, and low-density projections can be formed in the resulting bulky paper more easily. With the thickness being 1.5 mm or smaller, the bulky paper is effectively prevented from suffering from holes.

It is preferred for the perforated patterning structure 32 to be water repellent for securing stability in papermaking (i.e., releasability of the fiber web 2 clinging to the perforated patterning net 31). It is still preferred for the perforated patterning structure 32 to have such water repellency as makes a contact angle of 60° or more, particularly 75° or more, with water. By using a perforated patterning net having such a perforated patterning structure, the fiber web which once clings to the perforated patterning net by suction patterning can be released more easily from the perforated patterning net when transferred to the other carrier belt, which is more suitable to high-speed papermaking. Where the material of the perforated patterning structure 32 is hydrophilic, the above water repellency is preferably obtained by treatment with a water-repellent coating. Specifically, the treatment includes a surface treatment with Teflon resins, urethane resins, etc. The releasability can also be improved by spraying on the perforated patterning structure a release agent such as polyolefin release agents, higher fatty acid release agents and mineral oil release agents. The contact angle as referred to above is determined by dropping 10 $\mu$l of water on a specimen (76 mm by 26 mm) of a perforated patterning structure by means of a syringe and immediately thereafter measuring the contact angle at 25° C. with Contact Anglemeter CA-D supplied by Kyowa Kaimen Kagaku.

The reinforcing carrier belt 33 which is used with the perforated patterning structure 32 in one body has a great number of openings 33'. It is used to enhance the strength of the perforated patterning net 31. For this purpose and for stable running of the perforated patterning net on the paper machine or the processing machine, the reinforcing carrier belt 33 preferably has a tensile strength of 20 kg/cm or more, particularly 40 kg/cm or more, especially 60 kg/cm or more, in its longitudinal direction (running direction). The tensile strength is obtained as a breaking strength in a tensile strength tester measured under conditions of 10 mm in width of a specimen, 100 mm in chuck distance, and 60 mm/min in pulling speed. In order to secure a sufficient air flow for imparting oblique orientation to fibers along the openings 35 of the perforated patterning structure 32 and a sufficient strength as a carrier belt, the individual openings 33' preferably have an area of 0.01 to 1 $mm^2$. In order to effectively prevent the resulting bulky paper from suffering from holes in its low-density projections, the opening area is still preferably 0.02 to 1 $mm^2$, particularly preferably 0.03 to 0.3 $mm^2$. For obtaining a sufficient air flow for imparting oblique orientation to the fibers along the openings 35 of the perforated patterning structure 32 and for obtaining sufficient strength as a carrier belt, the open area ratio of the reinforcing carrier belt 33 is preferably 10 to 70%, still preferably 15 to 50%, particularly preferably 18 to 25%. The least width of the constituent parts 33" of the reinforcing carrier belt 33 in the planar direction is preferably 0.05 to 1 mm, still preferably 0.10 to 0.30 mm. The reinforcing carrier belt 33 can be of the same type as a mesh belt woven of wires which is commonly used as a carrier belt for paper making and processing.

The sewing for uniting the perforated patterning structure 32 and the reinforcing carrier belt 33 according to the present embodiment is preferably carried out in such a manner as to leave no gap between the reinforcing carrier belt 33 and the perforated patterning structure 32. The method for uniting is not limited to sewing. For example, heat fusion can be used, or the perforated patterning structure 32 can be formed on the reinforcing carrier belt 33 by using a photosensitive resin.

The bulky paper production process by the use of the apparatus 1 shown in FIG. 1 will be described further. A fiber suspension is fed from the stock feed head 11 onto the paper layer-forming belt 21 to build up fibers on the paper layer-forming belt 21 to form a wet fiber web (paper layer) 2. The concentration of the fiber suspension is not limited and can be selected appropriately from the range capable of stably performing the paper layer forming step.

The water content in the fiber web 2 is reduced by the suction boxes 22 to adjust the water content of the fiber web 2 to be sent to the downstream patterning zone to a prescribed level. The water content is adjusted to 50 to 85% by weight, preferably 65 to 75% by weight, based on the weight of the fiber web 2 (i.e., the wet fiber web) to make it possible to sufficiently pattern the fiber web 2 in the patterning step. With the water content falling within this range, oblique-oriented fibers are effectively obtained by suction, and the effect of heat application in raising the temperature of water is exerted sufficiently.

Figure 3:
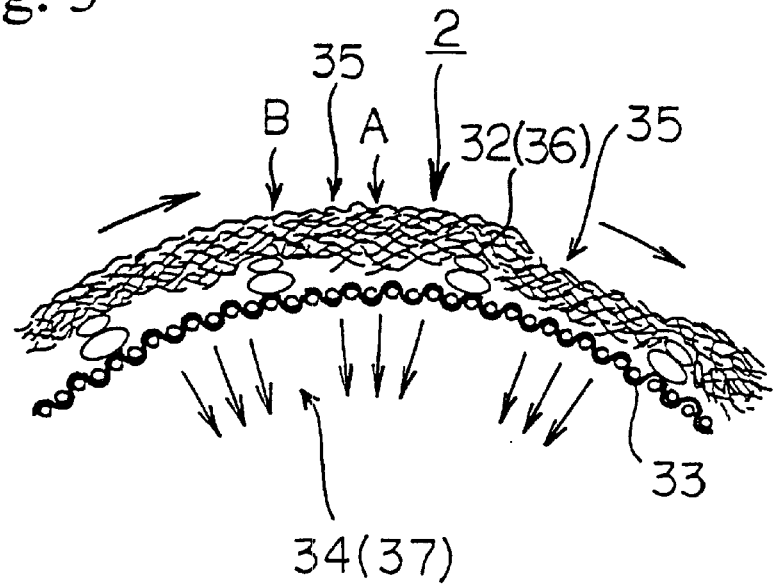
FIG. 3 is an enlarged partial view illustrating the state of a fiber web being sucked on a suction drum.

The fiber web 2 having its water content adjusted to a prescribed value is separated from the paper layer-forming belt 21 and transferred to the perforated patterning structure 32 of the perforated patterning net 31. In the suction drum 34 which is inside the revolving perforated patterning net 31, air is drawn in by means of the suction box 37 from the outside into the inside through the perforated patterning net 31. Accordingly, the areas of the fiber web 2 that are positioned over the openings 35 of the perforated patterning structure 32 (the areas will hereinafter be referred to as areas A) are sucked in the openings 35 by the suction to form convexities with the thickness increasing toward the inside of the suction box 37 as shown in FIG. 3. The areas A become areas of low fiber density, where the constituent fibers are less dense than before the suction. Underneath the perforated patterning structure 32 there is a reinforcing carrier belt 33 whose mesh is finer than that of the perforated patterning structure 32. Therefore, an abrupt increase in thickness (i.e., an abrupt decrease in density) in the areas A is restricted by the reinforcing carrier belt 33 so as not to make a big hole in the areas A or not to break the fiber web 2.

The areas of the fiber web 2 that are on the constituent parts 36 of the perforated patterning structure 32 and the vicinities of these areas (hereinafter these areas will be referred to as areas B) are pressed onto the constituent parts 36 and thus compressed by the suction and, as a result, get slightly thinner and denser than before suction. That is, the areas B become areas of higher fiber density relative to the areas A. These areas of high fiber density serve to suppress the tendency of the resulting bulky paper to show reduction in tensile strength due to the areas of low fiber density. Since the perforated patterning structure 32 has a continuous mesh pattern, the areas of high fiber density are also continuous, forming a mesh pattern, to further improve the tensile strength of the resulting bulky paper.

Simultaneously with the suction, steam is sprayed from the steam spray nozzle N to supply the fiber web 2 with 5 kcal/kg or more of heat thereby to raise the temperature of water in the fiber web 2 and to shorten the drying time. As a result, the areas A and B have enhanced shape retention, and the spraying pressure of steam facilitates formation of the areas A and B, thereby the fiber web 2 can be patterned more clearly. If the quantity of heat applied to the fiber web 2 is less than 5 kcal/kg, the temperature rise of the water contained in the fiber web 2 is insufficient, and the patterning of the fiber web 2 is not sufficient. A preferred range of the quantity of heat applied to the fiber web 2 is from 10 to 70 kcal/kg. In the present invention, the term "quantity of heat" is the quantity of heat applied per kilogram of the wet fiber web measured immediately before the heat application. The quantity of heat is calculated from the temperature difference between the fiber web 2 before and after passing through the heat application zone and the water content before passing through the heat application zone, defining the specific heat of the pulp and that of water as 0.4 cal/g and 1.0 cal/g, respectively. That is, the water content of the fiber web 2 before passing through the heat application zone and the temperature difference between before and after passing through the heat application zone being taken as x (wt %) and t (° C.), respectively, the quantity of heat Q (kcal/kg) applied to the fiber web 2 is represented by equation:

$$Q=\{0.4(1-x/100)+x/100\}\times t$$

The temperature and flow of the steam sprayed to the fiber web 2 are not particularly limited as long as the heat quantity given to the fiber web 2 is the above-specified value or higher. It is generally preferred that the steam immediately after being emitted from the nozzle has a temperature of 100° C. or higher and a flow rate of 2 m/sec or more, particularly 5 m/sec or more. While steam spray is used as a means for applying heat to the fiber web 2 in this particularly embodiment, other means, such as a hot air blow may be used. In this case, it is preferred for hot air to have a temperature of 50 to 300° C., particularly 100 to 250° C., and a flow rate of 2 m/sec or more, particularly 5 m/sec or more. The quantity of heat applied increases as the distance between the steam nozzle or the hot air nozzle and the fiber web 2 decreases. A suitable distance is 20 to 200 mm.

In this way, the fiber web 2 is given the pattern corresponding to the mesh pattern of the perforated patterning structure 32 as the perforated patterning net 31 runs along part of the peripheral surface of the suction drum 34.

The suction force of the suction box 37 in the patterning step, while dependent on the basis weight, the water content, etc. of the fiber web 2, preferably ranges, in general, from −10 to −100 kPa, particularly −25 to −70 kPa.

The fiber web 2 given a prescribed pattern in the patterning step is then introduced into a through air drier drum 41 of the drying zone, where it passes through hot air to dry. In this step, compression commonly carried out in ordinary papermaking process is not performed so that the bulkiness of the bulky paper may not be impaired.

As the drier 41 makes approximately one revolution, the fiber web dries to give bulky paper 3 as a final product. The resulting bulky paper 3 is wound by means of the winder 51 of the winding unit 50.

As described above, according to the present embodiment the patterning zone having the suction unit, the heat application unit, and the perforated patterning net is provided before the drying zone, and heat is applied near the suction unit to improve pattern forming properties thereby to produce bulky paper excellent in bulkiness and absorbency.

The apparatus shown in FIG. 1 and the process of production using the same present the following advantages (1) to (4).

(1) Since the perforated patterning net 31 revolves only about the suction drum 34 with partial contact therewith, there is no need to prepare a net of very long size.

(2) The profile of the pattern to be imparted to the fiber web 2 can be changed easily simply by exchanging the perforated patterning nets 31.

(3) Since the perforated patterning net 31 is not led into the drying zone, it is hardly deteriorated even when used continuously for a long time of period and therefore has a long lifetime.

(4) The apparatus can easily be switched to general papermaking to produce plain paper by shifting the whole patterning unit 30 to remove the perforated patterning net 31 from the running line of the fiber web 2.

Figure 4:
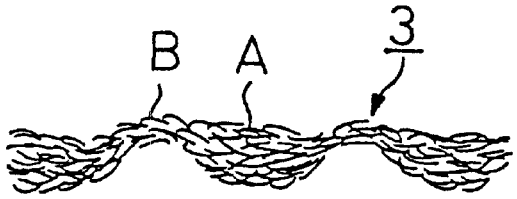
FIG. 4 is a schematic view showing the cross section of bulky paper obtained by the bulky paper production process according to the present invention.

A schematic cross section of the bulky paper thus produced is shown in FIG. 4. As shown in FIG. 4, the bulky paper 3 comprises areas A having a low fiber density and areas B having a high fiber density. The areas A, formed in conformity to the openings 35 of the perforated patterning structure 32, have a relatively large thickness. On the other hand, the areas B, formed in conformity to the constituent parts 36 surrounding the openings 35 of the perforated patterning structure 32, have a relatively small thickness. As a result, the bulky paper 3 is extremely bulky, having an uneven profile and a large thickness. Accordingly, it is highly absorbent and excellent in softness. The higher strength areas B making a continuous mesh pattern, the bulky paper 3 has moderate strength.

The fiber which constitutes the bulky paper 3 is preferably short fibers having a fiber length of 10 mm or less, particularly 0.5 to 5 mm. Such short fibers include wood pulp such as chemical pulp, semichemical pulp, mechanical pulp, etc. of softwood or hardwood; mercerized pulp or crosslinked pulp prepared by chemically treating the wood pulp; non-wood fibers, such as flax and cotton; cellulose fibers such as regenerated fibers, e.g., rayon fiber; and synthetic fibers, such as polyethylene fiber, polypropylene fiber, polyester fiber, and polyamide fiber. Of these fibers wood pulp, non-wood pulp, and cellulose fibers such as rayon fiber are preferred from the standpoint of product cost, strength, and suitability to papermaking. Wood pulp is still preferred from the standpoint of product cost. These short fibers are preferably used in a proportion of 50 to 100% by weight, particularly 70 to 100% by weight, based on the total fiber constituting the bulky paper 3.

Where the bulky paper 3 is used as an absorbent base of cooking paper, paper towels, tissues, etc. or as a cleaning sheet to be impregnated with a detergent, etc., the bulky paper 3 preferably contains 50 to 100% by weight of the cellulose fiber based on the total fiber. It is also preferred for the bulky paper to additionally contain a wet strength agent, such as polyamideamine epichlorohydrin resins, to exhibit wet strength. Such a wet strength agent is, in general, preferably added in an amount of 0.2 to 2.0% by weight based on the total weight of the bulky paper. In order to obtain a higher wet strength, it is also preferred to use a mixed wet strength agent comprising the above-mentioned polyamideamine epichlorohydrin resin mixed with an anionic polymer, such as carboxymethyl cellulose, or an ampholytic polymer, such as ampholytic polyacrylamide.

A second and a third embodiments will then be described. The particulars of the second and the third embodiments that are the same as those of the above-described first embodiment are not explained here, and the explanations given to the first embodiment apply thereto appropriately. The members of FIG. 5 that are the same as in FIGS. 1 to 4 are given the same numerical references.

The difference of the second embodiment from the first one lies in that the heat application conducted on the fiber web 2 in the first embodiment is not performed, that is, patterning of the fiber web 2 is effected only by the perforated patterning net 31 composed of the above-described reinforcing carrier belt 33 and the perforated patterning structure 32. In the second embodiment the water content of the fiber web to be forwarded to the patterning zone is adjusted to 50 to 99% by weight, preferably 65 to 90% by weight, still preferably 70 to 85% by weight. The reinforcing carrier belt has an individual opening area of 0.01 to 1 mm , an open area ratio of 10 to 70%, and a tensile strength of 20 kg/cm or more in its longitudinal direction. The perforated patterning structure has an individual opening area of 3 to 25 $mm^2$, an open area ratio of 18 to 96%, a least width of 0.1 to 5 mm in the pattern-forming constituent parts thereof in the planar direction, and a thickness of 0.3 to 1.5 mm. While the combination of heat application and the perforated patterning net 31 secures sufficient patterning of the fiber web 2 as mentioned above, it is still possible to pattern the fiber web 2 with the perforated patterning net 31 alone as will be apparent from Examples hereinafter given.

In the third embodiment, too, patterning is carried out with the perforated patterning net alone similarly to the second embodiment. In this embodiment, the fiber web before being transferred to the patterning zone is adjusted to have a water content of 50 to 99% by weight, preferably 65 to 90% by weight, still preferably 70 to 85% by weight. The perforated patterning net used here has an individual opening area of 3 to 8 $mm^2$, an open area ratio of 15 to 65%, a least width of 0.2 to 5 mm in the pattern-forming constituent parts thereof in the planar direction, a thickness of 0.5 to 3.0 mm, and a tensile strength of 20 kg/cm or more in the longitudinal direction thereof.

Figure 5A:
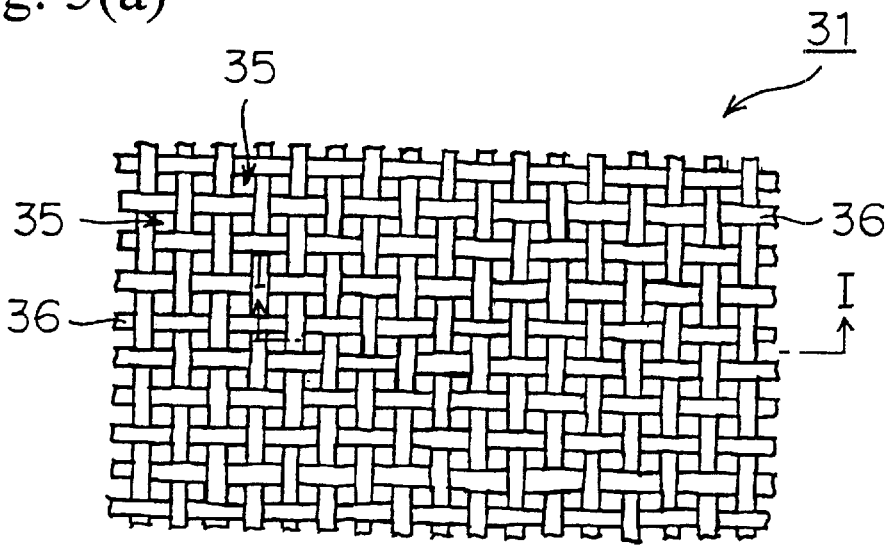
FIG. 5(*a*) is an enlarged partial plan view of a perforated patterning net used in a third embodiment, and FIG. 5(*b*) is a cross sectional view taken along line I—I of FIG. 5(*a*).
Figure 5B:
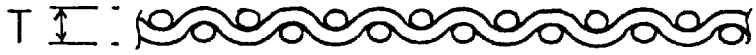

In more detail, the perforated patterning net 31 is a net woven of resin-made wires (a plain weave net in the present embodiment) having a great number of square openings 35 to form a mesh pattern over the entire area thereof as shown in FIGS. 5(*a*) and (*b*).

The openings 35 of the perforated patterning net 31 shown in FIGS. 5(*a*) and (*b*) each have an area of 3 to 8 $mm^2$, preferably 4 to 7 $mm^2$. If the area is less than 3 $mm^2$, the fibers are not sufficiently obliquely oriented along the openings 35, failing to form satisfactory low-density projections in the bulky paper. If the area exceeds 8 $mm^2$, the fibers may fall off by suction, and it is likely that the resulting bulky paper has holes. Further, the high-density areas formed in the bulky paper in a mesh pattern will have a reduced area, failing to provide bulky paper with sufficient strength.

The open area ratio of the perforated patterning net 31 is 15 to 65%. If the open area ratio is less than 15%, the total area of the areas forming the low-density projections will be reduced, failing to provide bulky paper having a high absorption capacity and good texture. If the open area ratio exceeds 65%, the total area of the high-density areas will be reduced, failing to provide bulky paper with sufficient strength. A preferred open area ratio is from 35 to 60%.

The least width, in the planar direction, of the net-forming constituent parts 36 of the perforated patterning net 31 is 0.2 to 5 mm. If the least width is smaller than 0.2 mm, the high-density areas formed in the resulting bulky paper in a mesh pattern will be too narrow to provide bulky paper with sufficient strength. If it exceeds 5 mm, the high-density areas formed in the resulting bulky paper in a mesh pattern will be too wide, only to provide paper with a hard texture. The least width of the constituent parts 36 in the planar direction is preferably 0.4 to 3 mm, still preferably 0.5 to 2.0 mm.

The perforated patterning net 31 has a thickness T (see FIG. 5(*b*)) of 0.5 to 3.0 mm, preferably 0.7 to 2.5 mm, still preferably 1.0 to 2.0 mm. If the thickness T is smaller than 0.5 mm, the fibers are not sufficiently guided into the openings 35, failing to form satisfactory low-density projections in the resulting bulky paper. If it exceeds 3.0 mm, the fibers will not be obliquely oriented along the openings 35, and holes are liable to be formed in the bulky paper when a suction force is strong.

Similarly to the first and second embodiments, it is preferred that the perforated patterning net 31 be water-repellent from the standpoint of papermaking stability. It is still preferred for the perforated patterning net 31 to have such water repellency as makes a contact angle of 60° or more, particularly 75° or more, with water.

Because the perforated patterning net 31 is made to revolve basically alone, it should have sufficient strength for withstanding the revolution. For this purpose, the perforated patterning net 31 is designed to have a tensile strength of 20 kg/cm or more, preferably 40 kg/cm or more, still preferably 60 kg/cm or more, in the longitudinal direction (i.e., in the running direction) thereof If the tensile strength is less than 20 kg/cm, the perforated patterning net is incapable of running stably on the paper machine or the processing machine.

The perforated patterning net 31 can be of the same type as a plastic net woven of wires which is commonly used as a carrier belt for paper making and processing as far as the above-mentioned conditions of area of the individual openings, open area ratio, thickness and tensile strength are fulfilled, and the least width of the constituent parts in the planar direction ranges as defined above. Nets made of glass fiber, Kevlar fiber, metallic yarn, etc. are also employable.

The second and third embodiments offer the following advantage in addition to the advantages (1) to (4) mentioned with reference to the first embodiments. Since patterning of the fiber web can be achieved without forwarding the perforated patterning net 31 to the drying zone, it is possible to use a perforated patterning net made of a non-heat-resistant material having a softening point of 250° C. or lower.

The present invention is not limited to the above-described embodiments. For example, the steam spray nozzle N used in the first embodiment may be set in the upstream or downstream side of the suction box 37 in the running direction of the fiber web 2 so that heat is applied to the fiber web 2 before or after the suction by the suction box 37.

The perforated patterning net integrally composed of the perforated patterning structure and the reinforcing carrier belt used in the first embodiment may be replaced with a perforated patterning net consisting solely of a single wire mesh belt as is used in the third embodiment.

The perforated patterning net used in the third embodiment includes not only the one shown in FIGS. 5(*a*) and (*b*)

that has square openings but also one having rectangular or other shaped-openings or one having an arbitrary combination of these opening shapes. The perforated patterning net may be used in combination with other mesh belts.

The apparatus used in each of the above-described embodiments can have a Yankee drier between the drying unit 40 and the winding unit 50 and a doctor blade for craping at the outlet of the Yankee drier to further improve the texture of the resulting bulky paper. In this case, it is desirable to reduce the degree of drying the fiber web in the drier 41.

While the present invention has been described with reference to the embodiments in which the formed wet fiber web is patterned in the line of a paper machine (in-line patterning), it is possible to adopt an embodiment in which papermaking is carried out in a usual manner, and the paper obtained by general papermaking is re-wetted to make a fiber web having the above-described water content, which is then patterned by use of an apparatus having a perforated patterning net revolving along a suction part (off-line patterning).

Explanations relating to conventionally known papermaking techniques appropriately apply to the particulars of the bulky paper production process that have not been described in detail.

The present invention also provide the following embodiments.

An apparatus for producing bulky paper characterized by having a patterning zone which is provided before a drying zone and has a suction unit, a heat application unit, and a perforated patterning net revolving along the suction unit.

A perforated patterning net having a large number of openings which is for patterning a fiber web held thereon by suction, the fiber web having a water content of 50 to 99% by weight, which is characterized in that:

the perforated patterning net is composed of a reinforcing carrier belt and a perforated patterning structure which is superposed on the reinforcing carrier belt and on which the fiber web is held, the reinforcing carrier belt has an individual opening area of 0.01 to 10 $mm^2$, an open area ratio of 10 to 70%, and a tensile strength of 20 kg/cm or more in its longitudinal direction, and the perforated patterning structure has an individual opening area of 3 to 25 mm , an open area ratio of 18 to 96%, a least width of 0.1 to 5 mm in the pattern-forming constituent parts thereof in the planar direction, and a thickness of 0.3 to 1.5 mm.

An apparatus for producing bulky paper having a patterning zone which is provided before a drying step and has a suction unit and a perforated patterning net revolving along the suction unit, which is characterized in that:

the perforated patterning net is composed of a reinforcing carrier belt and a perforated patterning structure which is superposed on the reinforcing carrier belt and on which the fiber web is held, the reinforcing carrier belt has an individual opening area of 0.01 to 10 $mm^2$, an open area ratio of 10 to 70%, and a tensile strength of 20 kg/cm or more in its longitudinal direction, and the perforated patterning structure has an individual opening area of 3 to 25 $mm^2$, an open area ratio of 18 to 96%, a least width of 0.1 to 5 mm in the pattern-forming constituent parts thereof in the planar direction, and a thickness of 0.3 to 1.5 mm.

A perforated patterning net having a large number of openings which is for patterning a fiber web held thereon by suction, the fiber web having a water content of 50 to 99% by weight, which is characterized in that:

the perforated patterning net has an individual opening area of 3 to 8 $mm^2$, an open area ratio of 15 to 65%, a least width of 0.2 to 5 mm in the pattern-forming constituent parts thereof in the planar direction, a thickness of 0.5 to 3.0 mm, and a tensile strength of 20 kg/cm or more in its longitudinal direction.

An apparatus for producing bulky paper having a patterning zone which is provided before a drying step and has a suction unit and a perforated patterning net revolving along the suction unit, which is characterized in that:

the perforated patterning net has an individual opening area of 3 to 8 $mm^2$, an open area ratio of 15 to 65%, a least width of 0.2 to 5 mm in the pattern-forming constituent parts thereof in the planar direction, a thickness of 0.5 to 3.0 mm, and a tensile strength of 20 kg/cm or more in its longitudinal direction.

EXAMPLES

The advantages of the present invention will be demonstrated by way of Examples.

Examples 1

A mixed pulp raw material consisting of 60 wt % of softwood bleached kraft pulp (NBKP; weight average fiber length: 2.35 mm) and 40 wt % of hardwood bleached kraft pulp (LBKP; weight average fiber length: 0.74 mm) was beaten by a refiner to a Canadian Standard Freeness (CSF) of 640 ml. To a 2 wt % slurry of the pulp raw material were added 0.6 wt % (based on the weight of the pulp) of a polyamideamine epichlorohydrin resin WS-570 (produced by Nippon PMC) as a wet strength agent and 0.25 wt % (based on the weight of the pulp) of carboxymethyl cellulose WS-A (produced by Dai-ichi Kogyo Seiyaku Co., Ltd.) as a dry strength agent and a yield improver for the polyamideamine epichlorohydrin resin to prepare a paper stock. Bulky paper was produced by using the prepared stock on the paper machine shown in FIG. 1. The paper layer-forming belt 21 in FIG. 1 was a polyester belt of 1,4-satin weave (90 mesh/inch by 85 mesh/inch).

The paper stock diluted to 0.1 wt % was fed from the stock feed head 11 of the paper machine shown in FIG. 1 to the paper layer-forming belt 21 and suction-dewatered by the suction box 22 to form a fiber web 2 having a water content of 75 wt %. The fiber web 2 was forwarded to the perforated patterning net 31 revolving along part of the peripheral surface of the suction drum 34 and sucked by the suction box 37 set in the suction drum 34 under a force of −46.5 kPa. At the same time, steam was sprayed onto the fiber web from the steam spray nozzle N which was placed on the periphery of the perforated patterning net 31 in the position facing the suction box 37 thereby to impart a prescribed pattern to the fiber web. The quantity of heat applied to the fiber web was 14.45 kcal/kg. The perforated patterning net 31 used here was made by sewing together a resin net 32 having circular openings prepared by melt extrusion of polypropylene and a reinforcing carrier belt 33 (OS-80, produced by Nippon Filcon Co., Ltd.) as shown in FIGS. 2(*a*) and (*b*). The polypropylene net had a individual opening area of 7.1 $mm^2$, an open area ratio of 65.3%, a width of 0.7 mm in the opening-forming constituent parts thereof, and a thickness of 0.71 mm. The reinforcing carrier belt had an individual opening area of 0.023 $mm^2$, an open area ratio of 18.8%, and a tensile strength of 67.7 kg/cm in its longitudinal direction. The polypropylene resin had a contact angle with water of 92° so that the fiber web 2 might be easily released from the resin net 32. The papermaking speed in the bulky paper production was 150 m/min.

The patterned fiber web 2 was transferred to the pickup carrier belt 23 by weak suction with the weak suction box 39 and sent into the drier 41, where the fiber web 2 was passed in hot air of 250° C. and dried to obtain bulky paper 3 having a basis weight of 22 g/m$^2$.

Example 2

Bulky paper having a basis weight of 22 g/m$^2$ was produced in the same manner as in Example 1, except that the flow rate of steam was controlled to give 8.50 kcal/kg of heat to the fiber web.

Example 3

Figure 6A:
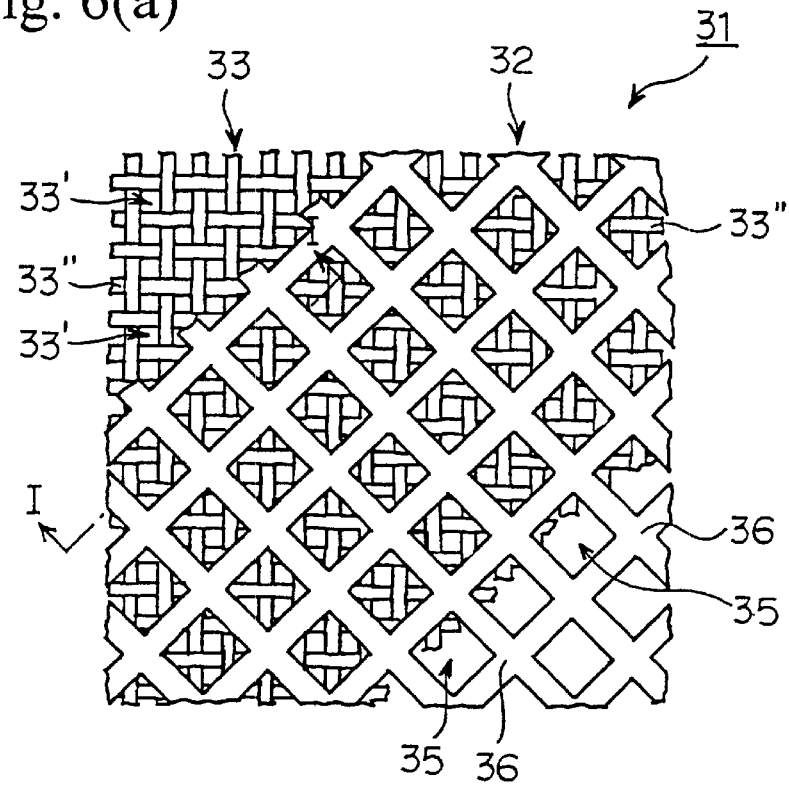
FIG. 6(*a*) is a plan view showing another example of a perforated patterning net used in the first embodiment (corresponding to FIG. 2(*a*)), and FIG. 6(*b*) is a cross sectional view taken along line I—I of FIG. 6(*a*) (corresponding to FIG. 2(*b*)).
Figure 6B:
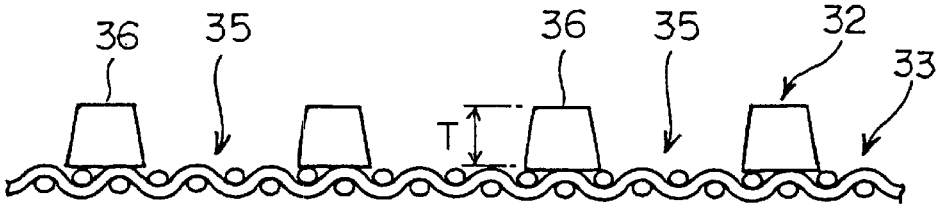

Bulky paper having a basis weight of 22 g/m$^2$ was produced in the same manner as in Example 1, except for controlling the flow rate of steam to give 29.75 kcal/kg of heat to the fiber web and using, as the perforated patterning net 31, a net comprising a reinforcing carrier belt 33 (OS-80, produced by Nippon Filcon Co., Ltd.) and a perforated patterning structure 32 which is formed on the belt 33. The perforated patterning structure 32 has square openings as shown in FIGS. 6(*a*) and (*b*), comprises a photosensitive resin (PVA and a tetrazonium salt) and is coated with a urethane resin.

Example 4

Bulky paper having a basis weight of 22 g/m$^2$ was produced in the same manner as in Example 1, except for controlling the flow rate of steam to give 32.30 kcav/kg of heat to the fiber web, using a single wire mesh belt as the perforated patterning net 31, and carrying out the suction by the suction box 37 under a suction force of −33 kPa.

The wire mesh belt used was a net woven of resin-made wires (a plain weave net in this Example) to form a large number of square openings 35 over the entire surface thereof in a mesh pattern. That is, this single belt performs the functions of the perforated patterning structure 32 and the reinforcing carrier belt 33 used in Example 1.

Example 5

Bulky paper having a basis weight of 22 g/m$^2$ was produced in the same manner as in Example 4, except that hot air of 200° C. was blown from the same nozzle N used for steam spraying onto the fiber web to apply 11.05 kcal/kg of heat quantity.

The production conditions of the foregoing Examples are summarized in Table 1.In order to examine the thickness, strength and absorbing properties of the bulky paper prepared in the foregoing Examples, the average dry thickness (under a load of 3 g/cm$^2$ or 23 g/cm$^2$), the average wet thickness (under a load of 3 g/cm$^2$ or 23 g/cm$^2$), the dry tensile strength (MD or CD), the wet tensile strength (MD or CD), and the saturation water absorption per unit area were measured according to the following methods. The results obtained are shown in Table 2.

Average Dry Thickness

An acrylic resin plate measuring 5 cm by 5 cm and weighing 75 g was put on a sheet of the bulky paper to give a load of 3 g/cm$^2$, and the average dry thickness of the bulky paper under the load was measured with a thickness meter (R5-C) supplied by Ozaki Seisakusyo. Further, an average dry thickness of the bulky paper under a load of 23 g/cm$^2$ was measured with a 500 g weight put on the acrylic plate.

Average Wet Thickness

The bulky paper was cut to 7 cm by 7 cm. The cut piece was soaked in a large amount of water for 5 seconds and then drained for 10 seconds. The average wet thickness of the resulting wet piece was measured in the same manner as in the measurement of the average dry thickness.

Dry Tensile Strength

The bulky paper was cut into a 25 mm wide and 100 mm long strip. Immediately thereafter, the strength at break was measured with a universal compression tensile tester (RTM-25, manufactured by Orientec) at a pulling speed of 300 mm/min and a chuck distance of 50 mm. In Table 2, MD indicates the strength in the running direction of the paper machine, and CD the strength in the crossing direction.

Wet Tensile Strength

The bulky paper was cut into a 25 mm wide and 100 mm long strip and soaked in a large amount of water for 5 seconds and drained for 10 seconds. The strength at break of the wet strip was measured in the same manner as for the dry tensile strength.

Saturation Water Absorption

The bulky paper was cut into a 7 cm by 7 cm square and soaked in a large amount of water for 20 seconds and drained for 30 seconds. The amount of water absorbed into the bulky paper (g/49 cm$^2$) was measured with a balance.

TABLE 1

| | Example No. | | | | |
|---|---|---|---|---|---|
| | 1 | 2 | 3 | 4 | 5 |
| Water Content (%) of Fiber Web Before Passing Through Suction Unit | 75 | 75 | 75 | 75 | 75 |
| Temp. (° C.) of Fiber Web Before Passing Through Suction Unit | 20 | 20 | 20 | 20 | 20 |
| Heat Source | steam | steam | steam | steam | hot air |
| Temp. (° C.) of Fiber Web After Passing Through Suction Unit | 37 | 30 | 55 | 58 | 33 |
| Heat Applied in Patterning (kcal/kg) | 14.45 | 8.50 | 29.75 | 32.30 | 11.05 |
| Suction Force in Patterning (kPa) | −46.5 | −46.5 | −46.5 | −33 | −33 |
| Perforated Patterning Structure | | | | | |
| Shape of Openings | circle | circle | square | square | square |
| Individ. Opening Area (mm$^2$) | 7.1 | 7.1 | 7.0 | 3.7 | 3.7 |
| Open Area Ratio (%) | 65.3 | 65.3 | 80.7 | 46.2 | 46.2 |
| Least Width of Constituent Parts (mm) | 0.7 | 0.7 | 0.2 | 0.9 | 0.9 |

TABLE 1-continued

| | Example No. | | | | |
|---|---|---|---|---|---|
| | 1 | 2 | 3 | 4 | 5 |
| Thickness (mm) | 0.71 | 0.71 | 0.55 | 1.8 | 1.8 |
| Material | polypropylene | polypropylene | PVA + tetrazonium salt | polyester | polyester |
| Water Repellency Treatment | — | — | urethane coating | — | — |
| Contact Angle with Water (° C.) | 92 | 92 | 83 | 77 | 77 |
| Reinforcing Carrier Belt | | | | | |
| Individ. Opening Area ($mm^2$) | 0.023 | 0.023 | 0.023 | — | — |
| Open Area Ratio (%) | 18.8 | 18.8 | 18.8 | — | — |
| Tensile Strength (kg/cm) | 67.7 | 67.7 | 67.7 | 85 | 85 |
| Method of Uniting Perforated Patterning Structure and Reinforcing Carrier Belt | sewing | sewing | sewing | — | — |

TABLE 2

| | Example No. | | | | |
|---|---|---|---|---|---|
| | 1 | 2 | 3 | 4 | 5 |
| Average Dry Thickness (mm) | | | | | |
| 3 g/cm | 0.75 | 0.71 | 0.70 | 0.77 | 0.72 |
| 23 g/cm | 0.58 | 0.54 | 0.58 | 0.56 | 0.52 |
| Average Wet Thickness (mm) | | | | | |
| 3 g/cm | 0.60 | 0.58 | 0.59 | 0.58 | 0.55 |
| 23 g/cm | 0.49 | 0.46 | 0.47 | 0.33 | 0.27 |
| Dry Tensile Strength (g/25 mm) | | | | | |
| MD | 1150 | 1150 | 1050 | 870 | 940 |
| CD | 910 | 900 | 780 | 460 | 470 |
| Wet Tensile Strength (g/25 mm) | | | | | |
| MD | 350 | 350 | 350 | 260 | 295 |
| CD | 210 | 220 | 210 | 185 | 190 |
| Saturation Water Absorption ($g/49\ cm^2$) | 1.05 | 1.03 | 1.06 | 0.93 | 0.89 |

As is apparent from the results shown in Tables 1 and 2, the bulky paper obtained by sucking a fiber web while applying a specific amount of heat (Examples 1 to 5) has a large thickness, high absorption, and moderate strength.

Example 6

Bulky paper having a basis weight of 22 $g/m^2$ was obtained in the same manner as in Example 1, except that heat application by steam was not conducted.

Example 7

Bulky paper having a basis weight of 22 $g/m^2$ was produced in the same manner as in Example6, except for using a perforated patterning net 31 made by sewing together a resin net 32 having rectangular openings which was prepared by melt extrusion of polypropylene and a reinforcing carrier belt 33 (OS-80, produced by Nippon Filcon Co., Ltd.).

Example 8

Bulky paper having a basis weight of 22 $g/m^2$ was produced in the same manner as in Example 6, except for using, as the perforated patterning net 31, a reinforcing carrier belt 33 (OS-80, produced by Nippon Filcon Co., Ltd.) having formed thereon a perforated patterning structure 32 having square openings comprising a photosensitive resin (PVA and a tetrazonium salt) and coated with a urethane resin.

Example 9

Bulky paper having a basis weight of 22 $g/m^2$ was produced in the same manner as in Example 6, except for using a perforated patterning net 31 made by sewing together a perforated patterning structure 32 having square openings which comprises a leno weave net of flat glass fibers coated with a Teflon resin and a reinforcing carrier belt 33 (OP-18K, produced by Nippon Filcon Co., Ltd.).

Example 10

Bulky paper having a basis weight of 22 $g/m^2$ was produced in the same manner as in Example 6, except for using a perforated patterning net 31 made by sewing together the polypropylene resin net 32 used in Example 6 and a reinforcing carrier belt 33 (OP-8, produced by Nippon Filcon Co., Ltd.).

Comparative Example 1

Bulky paper having a basis weight of 22 $g/m^2$ was produced in the same manner as in Example 6, except that the suction by the suction box 37 was not carried out.

Comparative Example 2

Bulky paper having a basis weight of 22 $g/m^2$ was produced in the same manner as in Example 6, except for using a perforated patterning net 31 made by sewing together a polypropylene resin net 32 having square openings which was prepared by melt extrusion and a reinforcing carrier belt 33 (OS-80, produced by Nippon Filcon Co., Ltd.).

The production conditions of the foregoing Examples and Comparative Examples are summarized in Table 3. The average dry thickness (under a load of 3 $g/cm^2$ or 23 $g/cm^2$), the average wet thickness (under a load of 3 $g/cm^2$ or 23 $g/cm^2$), the dry tensile strength (MD or CD), the wet tensile strength (MD or CD), and the saturation water absorption per unit area of the bulky paper of the foregoing Examples and Comparative Examples were measured. The results of the measurements are shown in Table 4.

TABLE 3

| | Example No. | | | | | Compara. Example No. | |
|---|---|---|---|---|---|---|---|
| | 6 | 7 | 8 | 9 | 10 | 1 | 2 |
| Water Content (%) of Fiber Web Before Suction Patterning | 75 | 75 | 75 | 75 | 75 | 75 | 75 |
| Suction Force in Patterning (kPa) | −46.5 | −46.5 | −46.5 | −46.5 | −46.5 | 0 (no suction) | −46.5 |
| Perforated Patterning Structure | | | | | | | |
| Shape of Openings | circle | rectangular | square | square | circle | circle | square |
| Individ. Opening Area ($mm^2$) | 7.1 | 4.5 | 7.0 | 20 | 7.1 | 7.1 | 1.6 |
| Open Area Ratio (%) | 65.3 | 47 | 80.7 | 66.8 | 65.3 | 65.3 | 68.4 |
| Least Width of Constituent Parts (mm) | 0.7 | 1.0 | 0.2 | 1.0 | 0.7 | 0.7 | 0.25 |
| Thickness (mm) | 0.71 | 1.5 | 0.55 | 1.05 | 0.71 | 0.71 | 0.51 |
| Material | polypropylene | polypropylene | PVA + tetrazonium salt | glass fiber | polypropylene | polypropylene | polypropylene |
| Water Repellency Treatment | — | — | urethane coating | Teflon coating | — | — | — |
| Contact Angle with Water (° C.) | 92 | 92 | 83 | 77 | 92 | 92 | 92 |
| Reinforcing Carrier Belt | | | | | | | |
| Individ. Opening Area ($mm^2$) | 0.023 | 0.023 | 0.023 | 0.74 | 3.74 | 0.023 | 0.023 |
| Open Area Ratio (%) | 18.8 | 18.8 | 18.8 | 36.8 | 46.2 | 18.8 | 18.8 |
| Tensile Strength (kg/cm) | 67.7 | 67.7 | 67.7 | 130.0 | 85.0 | 67.7 | 67.7 |
| Method of Uniting Perforated Patterning Structure and Reinforcing Carrier Belt | sewing | sewing | resin adhesion | sewing | sewing | sewing | sewing |

TABLE 4

| | Example No. | | | | | Compara. Example No. | |
|---|---|---|---|---|---|---|---|
| | 6 | 7 | 8 | 9 | 10 | 1 | 2 |
| Average Dry Thickness (mm) | | | | | | | |
| 3 g/cm | 0.66 | 0.57 | 0.62 | 0.78 | 0.69 | 0.28 | 0.35 |
| 23 g/cm | 0.51 | 0.45 | 0.49 | 0.58 | 0.52 | 0.16 | 0.27 |
| Average Wet Thickness (mm) | | | | | | | |
| 3 g/cm | 0.55 | 0.47 | 0.52 | 0.65 | 0.55 | 0.16 | 0.29 |
| 23 g/cm | 0.44 | 0.40 | 0.41 | 0.51 | 0.44 | 0.14 | 0.20 |
| Dry Tensile Strength (g/25 mm) | | | | | | | |
| MD | 1100 | 1250 | 1070 | 720 | 970 | 1950 | 1740 |
| CD | 870 | 960 | 790 | 460 | 750 | 1300 | 1220 |
| Wet Tensile Strength (g/25 mm) | | | | | | | |
| MD | 340 | 360 | 355 | 220 | 310 | 570 | 520 |
| CD | 210 | 230 | 220 | 155 | 190 | 390 | 360 |
| Saturation Water Absorption ($g/49\ cm^2$) | 0.97 | 0.86 | 0.95 | 1.06 | 0.99 | 0.62 | 0.69 |

As is apparent from the results shown in Tables 3 and 4, the bulky paper obtained in a specific method by using a specific perforated patterning net (Examples 6 to 10) has a large thickness, high absorption, and moderate strength compared with the comparative paper.

Example 11

Bulky paper having a basis weight of 22 $g/m^2$ was obtained in the same manner as in Example 1, except that the heat application with steam was not carried out and that the perforated patterning net 31 was a mesh belt woven of polyester resin wires in a plain weave which had square openings as shown in FIGS. 5(*a*) and (*b*), an individual opening area of 3.7 $mm^2$, an open area ratio of 46.2%, a width of 0.9 mm in the opening-forming constituent parts thereof, a thickness of 1.8 mm, and a tensile strength of 85 kg/cm in the longitudinal direction thereof The contact angle of the mesh belt with water was 77°.

Examples 12 and 13

Bulky paper having a basis weight of 22 $g/m^2$ was produced in the same manner as in Examples 11, except for using the perforated patterning net 31 shown in Table 5.

Comparative Example 3

Bulky paper having a basis weight of 22 g/m$^2$ was produced in the same manner as in Example 11, except that the suction by the suction box 37 was not conducted.

Comparative Example 4

Bulky paper having a basis weight of 22 g/m$^2$ was produced in the same manner as in Example 11, except for using the perforated patterning net 31 shown in Table 5.

The production conditions of the foregoing Examples and Comparative Examples are summarized in Table 5. The average dry thickness (under a load of 3 g/cm$^2$ or 23 g/cm$^2$), the average wet thickness (under a load of 3 g/cm$^2$ or 23 g/cm$^2$), the dry tensile strength (MD or CD), the wet tensile strength (MD or CD), and the saturation water absorption per unit area of the bulky paper of the foregoing Examples and Comparative Examples were measured. The results of the measurements are shown in Table 6.

TABLE 5

| | Example No. | | | Compara. Example No. | |
|---|---|---|---|---|---|
| | 11 | 12 | 13 | 3 | 4 |
| Water Content (%) of Fiber Web Before Suction Patterning | 75 | 75 | 75 | 75 | 75 |
| Suction Force in Patterning (kPa) | −33 | −33 | −33 | 0 (no suction) | −33 |
| Perforated Patterning Structure | | | | | |
| Shape of Openings | square | square | square | square | square |
| Individ. Opening Area (mm$^2$) | 3.7 | 5.5 | 7.9 | 3.7 | 2.3 |
| Open Area Ratio (%) | 46.2 | 56.0 | 53.8 | 46.2 | 39.4 |
| Least Width of Constituent Parts (mm) | 0.9 | 0.80 | 1.0 | 0.9 | 0.7 |
| Thickness (mm) | 1.8 | 1.5 | 2.3 | 1.8 | 1.8 |
| Tensile Strength (kg/cm) | 85 | 70 | 82 | 85 | 110 |
| Material | polyester | polyester | polyester | polyester | polyester |
| Contact Angle with Water (° C.) | 77 | 77 | 77 | 77 | 77 |

TABLE 6

| | Example No. | | | Compara. Example No. | |
|---|---|---|---|---|---|
| | 11 | 12 | 13 | 3 | 4 |
| Average Dry Thickness (mm) | | | | | |
| 3 g/cm | 0.68 | 0.74 | 0.81 | 0.30 | 0.40 |
| 23 g/cm | 0.48 | 0.52 | 0.58 | 0.16 | 0.27 |
| Average Wet Thickness (mm) | | | | | |
| 3 g/cm | 0.51 | 0.55 | 0.60 | 0.18 | 0.37 |
| 23 g/cm | 0.20 | 0.23 | 0.25 | 0.15 | 0.20 |
| Dry Tensile Strength (g/25 mm) | | | | | |
| MD | 960 | 890 | 850 | 1870 | 1370 |
| CD | 470 | 450 | 430 | 1240 | 950 |
| Wet Tensile Strength (g/25 mm) | | | | | |
| MD | 280 | 240 | 220 | 560 | 460 |
| CD | 190 | 170 | 160 | 370 | 320 |

TABLE 6-continued

| | Example No. | | | Compara. Example No. | |
|---|---|---|---|---|---|
| | 11 | 12 | 13 | 3 | 4 |
| Saturation Water Absorption (g/49 cm$^2$) | 0.84 | 0.90 | 0.95 | 0.64 | 0.72 |

As is apparent from the results shown in Tables 5 and 6, the bulky paper obtained in a specific method by using a specific perforated patterning net (Examples 11 to 13) has a large thickness, high absorption,. and moderate strength compared with the comparative paper.

Industrial Applicability

As described above in detail, according to the bulky paper production process of the present invention, pattern forming properties are improved by heat application near the suction unit to provide bulky paper with excellent bulkiness and absorbency.

Bulky paper having a large thickness, high absorbency, excellent softness, and moderate strength can be obtained.

Since the perforated patterning net only revolves along the suction unit, the net does not need to be so long.

According to the bulky paper production process of the present invention, the pattern profile can be changed easily simply by exchanging the perforated patterning nets.

Because the perforated patterning net 31 is not led into the drying zone, it is hardly deteriorated even when used continuously for a long time and therefore has a long lifetime. Further, this allows use of non-heat-resistant materials.

General papermaking can easily be carried out with the system simply by shifting the patterning unit out of the running line of the fiber web. That is, switching to general papermaking is easy.

What is claimed is:

1. A process for producing paper in bulk comprising the steps of:

forming a fiber web with a paper layer forming process;

transferring said fiber web having a water content of 50 to 85% by weight to a patterning zone having a perforated patterning net revolving along a suction unit;

patterning said fiber web in conformity with said perforated patterning net by a suction force to said fiber web from said suction unit, said fiber web being held on said perforated patterning net while applying 5 kcal/kg or more of heat to said fiber web in a heat application zone simultaneously with or before or after the application of said suction force to said fiber web; and drying said fiber web in a drying zone to obtain a patterned bulk paper, wherein a pickup carrier belt indirectly transfers said fiber web between said patterning and said drying steps, and said perforated patterning net is not led into the drying zone.

2. A process for producing paper in bulk according to claim 1, wherein said fiber web is dried by passing said fiber web through uncompressed hot air.

3. A process for producing paper in bulk according to claim 1, wherein said heat application zone includes steam spraying or hot air blowing sections.

4. The process for producing paper in bulk according to claim 1, said perforated patterning net comprising a reinforcing carrier belt and a perforated patterning structure being disposed on said reinforcing carrier belt and on which said fiber web is to be built up, said reinforcing carrier belt having an individual opening area of 0.01 to 10 $mm^2$, an open area ratio of 10 to 70%, and a tensile strength of 20 kg/cm or more in the longitudinal direction thereof, and said perforated patterning structure having an individual opening area of 3 to 25 $mm^2$, an open area ratio of 18 to 96%, a width of at least 0.1 to 5 mm in the pattern-forming constituent parts thereof in the planar direction, and a thickness of 0.3 to 1.5 mm.

5. The process for producing paper in bulk according to claim 4, wherein said perforated patterning structure has a water repellency as to form a contact angle of 60° or more with water.

6. The process for producing paper in bulk according to claim 1, said perforated patterning net having an individual opening area of 3 to 8 $mm^2$, an open area ratio of 15 to 65%, a width of at least 0.2 to 5 mm in the pattern-forming constituent parts thereof in the planar direction, a thickness of 0.5 to 3.0 mm, and a tensile strength of 20 kg/cm or more in the longitudinal direction thereof.

7. A process for producing bulky paper according to claim 6, wherein said perforated patterning net has a water repellency as to form a contact angle of 60° or more with water.

8. The process for producing paper in bulk according to claim 1, wherein the application of heat to said fiber web is carried out simultaneously with the sucking of said fiber web, and the quantity of heat applied to said fiber web is from 5 to 70 kcal/kg.

* * * * *